United States Patent [19]

Curran

[11] 3,980,223

[45] Sept. 14, 1976

[54] CELLULAR STRUCTURE FOR CARTONS

[76] Inventor: John J. Curran, 4470 Granville St., Vancouver, British Columbia, Canada, V6H 3L8

[22] Filed: June 2, 1975

[21] Appl. No.: 582,933

[52] U.S. Cl. ..... 229/28 R; 229/15

[51] Int. Cl.[2] ..... B65D 5/48

[58] Field of Search ..... 229/27, 28 R, 28 BC, 229/15, 42

[56] References Cited

UNITED STATES PATENTS

| | | | |
|---|---|---|---|
| 2,263,455 | 11/1941 | Coyle | 229/28 BC |
| 2,549,801 | 4/1951 | George | 229/42 |
| 2,739,735 | 3/1956 | Anderson, Jr. | 229/28 BC |
| 2,883,098 | 4/1959 | Horner et al. | 229/28 R |
| 3,116,851 | 1/1964 | Lemon | 229/28 R |
| 3,211,357 | 10/1965 | Weiss | 229/12 |
| 3,232,517 | 2/1966 | Weiss | 229/15 |
| 3,269,636 | 8/1966 | Holmes | 229/15 |
| 3,352,473 | 11/1967 | Graser | 229/15 |
| 3,868,055 | 2/1975 | Langen et al. | 229/42 |

*Primary Examiner*—William Price
*Assistant Examiner*—Bruce H. Bernstein
*Attorney, Agent, or Firm*—Fetherstonhaugh & Company

[57] ABSTRACT

A cellular structure for use in cartons having first and second parallel wall sections which are movable longitudinally relative to each other and away from each other during erection of the structure, outer dividers flaps cut from and hinged to the wall sections and extending longitudinally thereof and swingable outwardly therefrom, and inner flaps cut from the wall sections connected to and extending away from the outer flaps, opposed inner flaps being connected to each other so as to swing inwardly and cause the outer flaps connected thereto to swing outwardly when said wall sections are moved longitudinally relative to each other to form cells at the wall sections.

9 Claims, 5 Drawing Figures

CELLULAR STRUCTURE FOR CARTONS

Figure 2:
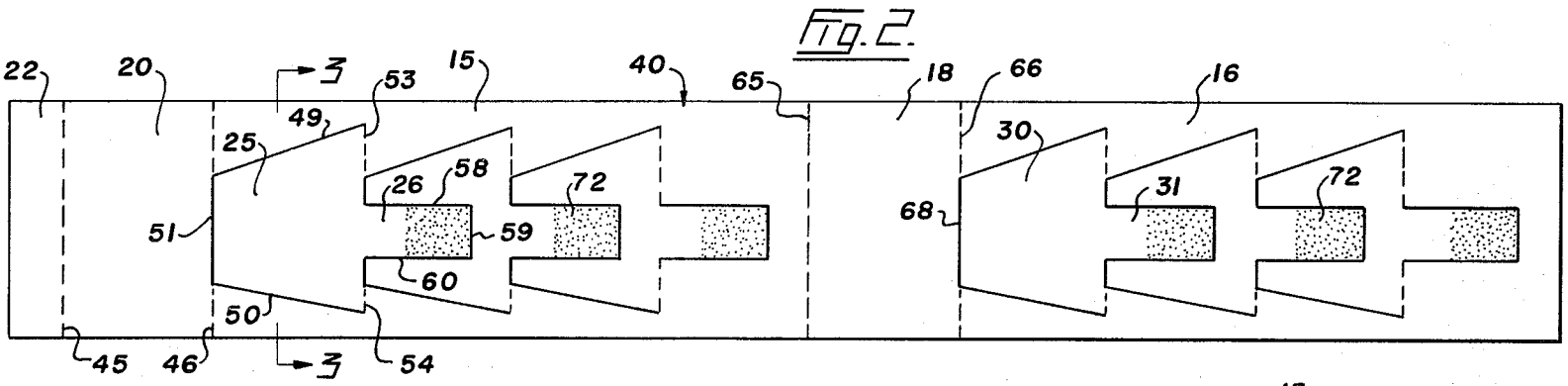

This invention relates to cellular structures for use in cartons and the like for separating articles, such as bottles, from each other within the carton.

There are many forms of prior cellular structures on the market and in the field in which this invention belongs. However, the cellular structures of the prior art require too much material, usually cardboard, and/or are die cut from one side of a sheet so that some or all of the swing-out panels or flaps with free outer ends are forced to open against the direction of withdrawal movement of the die. The use of too much material is wasteful and should be cut down if it is at all possible for economical and conservation reasons, and the previous die cutting often resulted in problems during the set-up and erection of the cellular structures.

Canadian Patent No. 672,989, dated Oct. 29, 1963, is a good example of a partion structure which utilizes considerably more cardboard than is absolutely necessary, and which is die cut in such a way that some of the swingable panels have to be opened against the direction of the die withdrawal.

The cellular structure of the present invention is such that considerably less cardboard is required for a structure of a given number of cells, and although each unit is die cut from one side of the sheet, all flaps having free ends are designed to swing out in the positive die cut direction, making set-up and erection of the unit more precise than has been previously possible.

The die cut unit of the above-mentioned patent is constructed on a 4 cell module to offer a cell pattern arrangement of 4 × 3, 4 × 4, 4 × 5, 4 × 6, 4 × 7 and the like. The benefits of the present invention are attained by a die cut unit constructed on a 3 cell module to offer a pattern arrangement of 3 × 4, 3 × 5, 3 × 6, 3 × 7, 3 × 8 and the like.

The following figures are merely representative and are not used in a limiting sense, but they serve to illustrate the amount of cardboard saved by the use of the present cellular structure. The expression "Standard Partition" refers to partition structures which are in general use today, while "Old Style" die cut refers to the partition structure of U.S. Pat. No. 672,989, and "New Style" die cut refers to the cellular structures of this invention.

The cardboard consumption of the Old Style unit in a 12 cell pattern was arrived at by using the formula - 7 × diameter × 2 cell height. The formula for a 24 cell pattern was based on 13 × diameter × 2 cell height.

The New Style uses a different pattern. The formula of a 12 cell unit is 10 × diameter plus 1 in. × cell height. The formula for a 24 cell unit is 18 × diameter plus 1 in. × cell height. The following comparative examples are for a cell size of 3 in. × 3 in. × 5 in. high.

| | | | |
|---|---|---|---|
| Standard Partition | - 12 cell - | 2 pc. 5"×12"=24<br>3 pc. 5"×9" =27 | |
| | | 5" × 51 " | - 255 sq. in. |
| Old Style die cut | - 12 cell - | (7×3")× 10" | - 210 sq. in. |
| New Style die cut | - 12 cell - | (10×3"+1")×5 | - 155 sq. in. |
| Standard Partition | - 24 cell - | 3 pc. 5"×18"=54<br>5 pc. 5"×12"=60 | |
| | | 5" × 144" | - 570 sq. in. |
| Old Style die cut | - 24 cell - | (13×13") × 10" | - 390 sq. in. |

-continued

| | | | |
|---|---|---|---|
| New Style die cut | - 24 cell - | (18×3"+1")×5" | - 275 sq. in. |

These examples show that cell structures in accordance with the present invention utilize 155 sq. in. of cardboard for a 12 cell structure, and 275 sq. in. for a 24 cell structure, and that these are considerably less than the Old Stype structure and the Standard Partition structure. This saving of material is very important from an economical standpoint, and particularly from a conservation of resources standpoint.

A cellular structure in accordance with the present invention comprises first and second parallel wall sections movable longitudinally relative to and towards and away from each other, outer divider flaps cut from and hinged to the wall sections each extending longitudinally from a hinge line extending transversely of its wall section and spaced from the ends thereof, said flaps being swingable outwardly relative to their respective wall sections, inner flaps cut from the wall sections each connected to an outer flap at the hinge line thereof and extending away from said outer flap, said inner flaps swinging inwardly when their respective outer flaps swing outwardly, and means securing opposed inner flaps of the two wall sections together to cause said connected inner flaps to swing inwardly and the outer flaps connected thereto to swing outwardly when said wall sections are moved longitudinally relative to each other to form cells at the wall sections.

Figure 3:
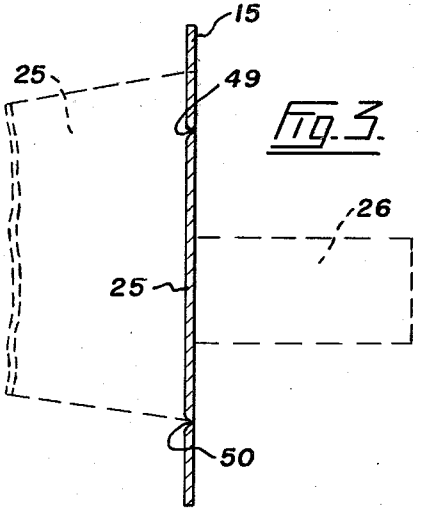
Figure 1:
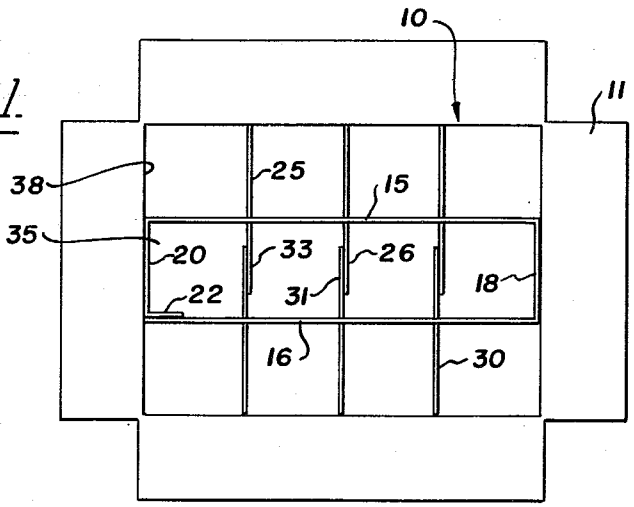
Figure 4:
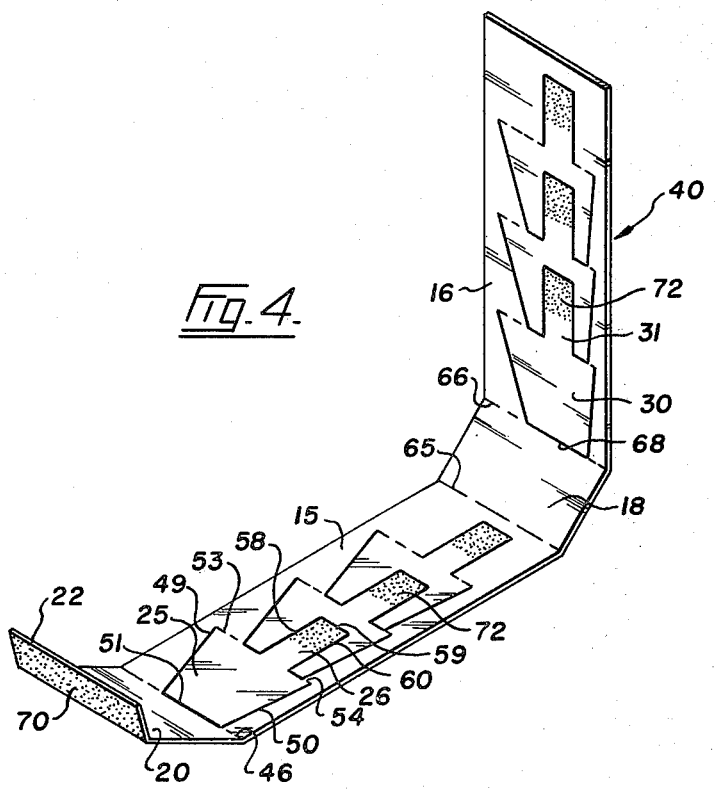
Figure 5:
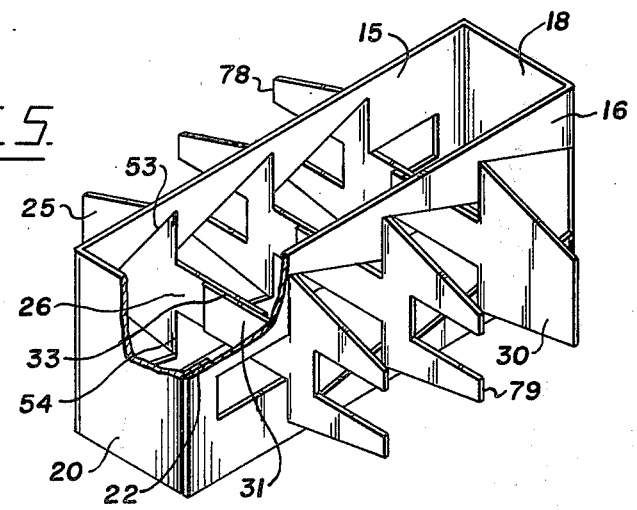

Preferred forms of this invention are illustrated in the accompanying drawings, in which FIG. 1 is a plan view of a 12 cell structure in accordance with this invention located in a carton, FIG. 2 is a view of the inner face of a died blank for this cell structure, FIG. 3 is an enlarged vertical section taken on the line 3—3 of FIG. 2, FIG. 4 is a perspective view of the blank of FIG. 2 being folded over for gluing, and FIG. 5 is a perspective view of the cell structure in the erected position.

Referring to the drawings, 10 is a preferred form of cellular structure in accordance with this invention placed in a carton 11. The cellular structure has two spaced-apart and parallel longitudinal wall sections 15 and 16. The wall sections 15 and 16 are actually formed from a single strip of material, such as cardboard, and are integrally connected together at one end by an end web 18, and at their opposite ends these wall sections are connected by an end web 20 which is integrally connected to wall section 15 and a connector flap 22 integrally connected to latter web, said flap being adhesively secured to wall section 16. Wall section 15 has die cut therefrom and hingedly connected thereto outer divider flaps 25 and inner divider flaps 26. Similarly, wall section 16 has die cut and integrally connected thereto outer flaps 30 and inner divider flaps 31. The opposed inner flaps 26 and 31 of the two longitudinal wall sections are glued together to form a single divider flap 33 between the two wall sections. The outer flaps 25 and 30, and inner flaps 26, 31 form a plurality of individual cells 35 between the wall sections themselves and between said wall sections and the peripheral wall 38 of the carton.

FIG. 2 illustrates a single strip of cardboard 40 forming wall sections 15 and 16, end webs 18 and 20, and connector flap 22, outer flaps 25 and 30, and inner flaps 26 and 31. End web 20 and connector flap 22 are formed by transverse crease lines 45 and 46 spaced from one end of strip 40 and from each other. Each divider flap 25 is formed by cuts 49, 50 and 51. The cuts 49 and 50 extend from transverse hinge or crease lines 53 and 54 and converge slightly therefrom to cut 51 which coincides with crease line 46. Each inner divider flap 26 is formed by die cuts 58, 59 and 60, cuts 58 and 60 being parallel to each other and being joined at outer ends by cut 59. The intermediate flap 26 connected to the first outer flap 25, starting from the left end of strip 40 in FIG. 2, is cut from the body of the second outer flap 25. The die cut 51 of this second flap is interrupted by the inner end of this inner flap 26. Crease lines 53 and 54 form a hinge connection between flap 25 and strip 40.

Outer flaps 30 and inner flaps 31 of wall section 16 are die cut and formed in the same manner as flaps 25 and 26 of wall 15. Spaced and parallel transverse crease lines 65 and 66 form end web 18, and line 66 coincides with cut 68 of the adjacent outer flap 30, said cut 68 corresponding with cut 51 of the first slap 25.

During manufacture of assembly 10, a strip of glue 70 is applied to the outer surface of connector flap 22, see FIG. 4, and glue spots 72 are applied to the inner surfaces of inner flaps 26 and/or inner flaps 31. End web 20 is folded inwardly along crease line 46 over wall section 15, and then wall section 16 is folded inwardly along crease line 66 until its outer or free end lies over connector flap 22 to which it is secured by glue 70. Portions of inner flaps 31 overly portions of inner flap 26 so that these flaps are secured together by glue 72.

FIG. 5 illustrates a cellular structure 10 in its erected position. In order to erect this structure, wall sections 15 and 16 are moved in opposite directions relative to each other until end webs 18 and 20 extend at right angles thereto. As the inner divider flaps 26 and 31 are adhesively secured together, this action causes outer flaps 25 and 30 to swing outwardly on hinge or crease lines 53 and 54 into positions substantially normal to their respective wall sections. The structure is now erected, and can be placed inside a carton 11 as shown in FIG. 1, thereby forming therewith the cells 35.

The saving of cardboard in cell structure 10 results from the fact that the two longitudinal wall sections 15 and 16 are each formed of a single thickness of material, while the outer flaps 25 and 30, and inner flaps 26 and 31 are formed out of material forming the two longitudinal wall sections.

FIG. 2 illustrates the inner face of strip 40. The cuts and crease lines are formed by a die which is pressed against the opposite or outer face of said strip. The die moves against and is withdrawn from the strip outer face.

By referring to FIG. 5, it will be seen that outer flaps 25 and 30 have free outer ends 78 and 79. When the cellular structure is erected, these outer flaps are swung outwardly by the joined inner flaps 26 and 31 that are connected to said outer flaps at the hinge lines thereof. As the outer flaps swing outwardly in the direction of withdrawal of the die, that is, outwardly relative to strip 40, these outer flaps readily come away from the strips so that there is practically no chance of the flaps sticking during erection, as frequently happens when divider flaps have to swing in the direction opposite to the withdrawal direction of the die.

It is true that the inner flaps 26 and 31 of this structure swings inwardly against the withdrawal movement of the die, but each flap 26 is secured to a flap 31 so that they brace each other, and in addition, these inner flaps do not have free outer ends at the time of erection of the cell structure. Thus, there is no danger of the inner flaps sticking at this time.

I claim:

1. A cellular structure for use in cartons and the like, comprising first and second parallel wall sections movable longitudinally relative to and towards and away from each other and adapted, when the cellular structure is in its erected position, to be spaced from the walls of the carton and the like to divide the carton and the like into three longitudinal compartments including a central longitudinal compartment defined between the first and second parallel wall sections, outer divider flaps cut from and hinged to the wall sections each extending longitudinally from a hinge line extending transversely of its wall section and spaced from the ends thereof, said flaps being swingable outwardly relative to their respective wall sections, flap inner cut from the wall sections each connected to an outer flap at the hinge line thereof and extending away from said outer flap, said inner flaps swinging inwardly when their respective outer flaps swing outwardly, and means securing opposed inner flaps of the two wall sections together to cause said connected inner flap to swing inwardly and the outer flap connected thereto to swing outwardly to divide said three longitudinal compartments into a plurality of cells when said wall sections are moved longitudinally relative to each other.

2. A cellular structure as claimed in claim 1, in which each inner flap is relatively narrow.

3. A cellular structure as claimed in claim 1, in which each outer divider flap is wider in the transverse direction of the wall section at an inner end thereof where said flap is hinged to said section than an outer end of said flap.

4. A cellular structure as claimed in claim 1, in which each of said wall sections has an outer face, and said divider flaps are die cut from said outer face.

5. A cellular structure as claimed in claim 1, in which adjacent ends of said wall sections are interconnected by an end web, said end web being hingedly connected to said ends of the wall sections.

6. A cellular structure as claimed in claim 1, in which said first and second wall sections are longitudinally aligned in a continuous strip of material transversely creased to form end webs hingedly connected to adjacent ends of the wall sections.

7. A cellular structure as claimed in claim 6, in which said wall sections have outer faces, and said divider flaps are die cut from said outer faces.

8. A cellular structure as claimed in claim 1, in which at least some of the inner flaps are cut from the material forming adjacent outer flaps.

9. A cellular structure for use in cartons and the like comprising first and second parallel wall sections movable longitudinally relative to and towards and away from each other and adapted, when the cellular structure is in its erected position, to be spaced from the walls of the carton and the like to divide the carton and the like into three longitudinal compartments including a central longitudinal compartment defined between the first and second parallel wall sections, divider flaps cut from and hinged to each wall section extending longitudinally thereof in opposite directions from hinge connections thereof, the flaps of each wall section extending in one direction being swingable outwardly therefrom, the flaps of each wall section extending in the opposite direction being swingable inwardly therefrom and means securing each inwardly swingable flap of the first wall section to an adjacent inwardly swingable flap of a second wall section to cause the flaps of the wall sections to swing respectively inwardly and outwardly to divide said three longitudinal compartments into a plurality of cells when said wall sections are moved longitudinally relative to each other.

* * * * *